US005809955A

United States Patent [19]

Murata et al.

[11] Patent Number: 5,809,955

[45] Date of Patent: Sep. 22, 1998

[54] HYDRAULIC ACTUATOR AND VARIABLE VALVE DRIVING MECHANISM MAKING USE OF THE SAME

[75] Inventors: Shinichi Murata, Okazaki; Masahiko Kubo, Kariya; Jun Isomoto, Chiryu, all of Japan

[73] Assignee: Mitsubishi Jidosha Kogyo Kabushiki Kaisha, Tokyo, Japan

[21] Appl. No.: 838,591

[22] Filed: Apr. 10, 1997

[30] Foreign Application Priority Data

Apr. 10, 1996 [JP] Japan ..... 8-088664

[51] Int. Cl.[6] ..... F01L 13/00; F15B 15/12

[52] U.S. Cl. ..... 123/90.17; 123/90.31; 92/121

[58] Field of Search ..... 123/90.12, 90.15, 123/90.17, 90.31, 90.6; 92/120, 121; 251/62

[56] References Cited

U.S. PATENT DOCUMENTS

| | | | |
|---|---|---|---|
| 3,633,555 | 1/1972 | Raggi | 123/90.17 |
| 3,670,627 | 6/1972 | Valantin | 92/121 |
| 4,565,119 | 1/1986 | Higuchi | 92/121 |
| 4,633,759 | 1/1987 | Schulze | 92/121 |
| 4,759,186 | 7/1988 | Sugden | 92/121 |
| 5,365,896 | 11/1994 | Hara et al. | 123/90.17 |
| 5,367,992 | 11/1994 | Butterfield et al. | 123/90.17 |
| 5,507,254 | 4/1996 | Mechior | 123/90.17 |
| 5,634,392 | 6/1997 | Najork et al. | 92/121 |

FOREIGN PATENT DOCUMENTS

| | | | |
|---|---|---|---|
| 516082 | 12/1952 | Belgium | 92/121 |
| 51107 | 4/1980 | Japan | 92/121 |
| 3-168309 | 7/1991 | Japan . | |
| 6-185321 | 7/1994 | Japan . | |
| 853147 | 9/1981 | U.S.S.R. | 92/121 |

*Primary Examiner*—Weilun Lo

[57] ABSTRACT

A hydraulic actuator is provided with a housing with an oil compartment formed therein; a power output shaft rotatably supported on the housing and extending out from an interior of the oil compartment to an exterior of the housing; a vane radially extending out from the power output shaft and maintained in contact with an inner wall of the oil compartment, whereby the vane divides the oil compartment into a first oil compartment and a second oil compartment; a first hydraulic pressure passage communicating the first oil compartment and a hydraulic pressure source with each other; a second hydraulic pressure passage communicating the second oil compartment and the hydraulic pressure source with each other; and an oil control valve regulating at least one of a first hydraulic pressure to be supplied to the first oil compartment through the first hydraulic pressure passage and a second hydraulic pressure to be supplied to the second oil compartment through the second hydraulic pressure passage. The power output shaft is specified in its rotated position by the first and second hydraulic pressures acting on the vane. A variable valve driving mechanism making use of the hydraulic actuator is also disclosed.

12 Claims, 9 Drawing Sheets

HYDRAULIC ACTUATOR AND VARIABLE VALVE DRIVING MECHANISM MAKING USE OF THE SAME

BACKGROUND OF THE INVENTION a) Field of the Invention

This invention relates to a hydraulic actuator suitable for use in a valve system of an internal combustion engine and also to a variable valve driving mechanism making use of the hydraulic actuator.

b) Description of the Related Art

In the case of an intake valve and exhaust valve arranged in an engine, the optimal timings of their opening and closing and their open periods vary in accordance with a load on the engine and its speed. A variety of mechanisms have therefore been proposed to make it possible to vary the timings of opening and closing of such valves and their open periods.

Developed mechanisms include, for example, those provided with a nonuniform speed coupling interposed between a cam and a camshaft. While rotating the cam relative to the camshaft via the nonuniform speed coupling, the cam is caused to rotate at a speed different from the camshaft to permit adjusting the timings of opening and closing of valves and their open periods.

FIG. 8 and FIG. 9 disclose a variable valve timing camshaft mechanism according to U.S. Pat. No. 3,633,555 as published in SAE Technical Paper Series 880387. This mechanism is designed to permit changing of the valve timing by using a nonuniform speed coupling. In FIG. 8 and FIG. 9, designated by numerals 101 and 102 are a camshaft and a cam, respectively, and the cam 102 is arranged to be able to rotate concentrically with the camshaft 101 and relative to the camshaft 101. Between this camshaft 101 and this cam 102, a nonuniform speed coupling 103 is interposed.

The nonuniform speed coupling 103 is provided with a collar 105 connected to the camshaft 101 via a locking screw 104 for integral rotation with the camshaft 101, an intermediate member 108 connected to the cam 102 via a drive pin 106 and slider 107 for integral rotation with the cam 102, and a drive pin 109 and slider 110 for transmitting rotation from the collar 105 to the intermediate member 108, and further with a rotation control sleeve 111 with the collar 105 and intermediate member 108 accommodated therein and a control shaft 112 for adjusting the phase of rotation of the rotation control sleeve 111.

The sliders 107,110 are accommodated slidably in radial directions in elongated grooves 108A,108B of the intermediate member 108, respectively, so that rotation of the camshaft 101 is transmitted from the collar 105 of the nonuniform speed coupling 103 to the intermediate member 108 via the drive pin 109 and slider 110, and further to the cam 102 via the slider 107 and drive pin 106.

Incidentally, the collar 105 and intermediate member 108 are rotatably supported so that they can freely rotate within the rotation control sleeve 111 with their respective outer peripheries 105A,108C maintained in sliding contact with an inner periphery 111A of the rotation control sleeve 111. A rotational center $O_2$ of the outer peripheries 105A,108C of the collar 105 and intermediate member 108 and the inner periphery 111A of the rotation control sleeve 111 are both eccentric relative to an axis (rotational center) $O_1$ of the camshaft 101.

Upon transmission of rotation of the camshaft 101 to the intermediate member 108 via the drive pin 109 and slider 110, the drive pin 109 and slider 110 rotate integrally with the collar 105 about the rotational center $O_1$, while the intermediate member 108 rotationally driven via these drive pin 109 and slider 110 rotates about the rotational center $O_2$. Accordingly, the slider 107 and drive pin 106 to which rotation is transmitted from the intermediate member 108 are not coincided in rotation with the camshaft 101, and rotate at a nonuniform speed.

According to a variable valve driving mechanism making use of a nonuniform speed coupling and constructed as described above, if the cam 102 is retarded than the camshaft 101 near the opening of the intake valve and the cam 102 is advanced than the camshaft 101 near the closing of the intake valve, then the valve open period becomes shorter. Valve drive control suited for the low speed operation of the internal combustion engine can hence be realized.

On the other hand, if the cam 102 is advanced than the camshaft 101 near the opening of the intake valve and the cam 102 is retarded than the camshaft 101 near the closing of the intake valve, then the valve open period becomes longer. Valve drive control suited for the high speed operation of the internal combustion engine can hence be realized.

Incidentally, the camshaft 101 provided with such a variable valve driving mechanism is generally arranged in an unillustrated cylinder head. In the cylinder head, bores are formed on a side of an end thereof and on a side of an opposite end thereof, respectively. The camshaft 101 extends at one end thereof through one of the bores to an outside of the cylinder head, and is provided at the externally-extending portion thereof with a sprocket, so that rotation of the crankshaft can be transmitted. On the side of the opposite end of the camshaft 101, in other words, at the other bore, the camshaft 101 does not extend through the cylinder head, and the other bore is closed up by a cap subsequent to the mounting of the camshaft.

To adjust the timing of opening and closing of the valve in such a variable valve driving mechanism or an internal combustion engine, it is necessary to adjust the phase of rotation of an eccentric member such as the above-described rotation control sleeve 111. This leads to a need for drive means for rotationally driving the eccentric member.

In the case of the above-mentioned conventional art, for example, it may be contemplated to connect drive means such as a motor to the control shaft 112 and then to rotationally drive the control shaft 112 so that the rotation control sleeve 111 is rotated via a gear mechanism 113 to adjust the driving timing of the valve. The motor as the drive means is not limited to an electric motor, and use of a hydraulic motor can also be contemplated.

Whichever motor is used, such a motor has to be mounted on the cylinder head. Substantially, however, no space is generally available inside the cylinder head for the mounting of such a motor, so that the motor has to be mounted outside the cylinder head. Even outside the cylinder head, an installation space for an engine (in the case of an automotive vehicle, an engine compartment) is limited. Also from structural limitations of an engine, it is therefore important to minimize the size of the motor and to determine the suitable position of the motor from the standpoint of its mounting man-hour and installation space.

Especially when a hydraulic motor is used as a motor for driving a variable valve driving mechanism, it becomes a theme how an actuator, a main body of the hydraulic motor, and an oil control valve or the like for controlling a hydraulic pressure should be constructed to minimize the size and also how oil passages should be formed to improve response characteristics and reliability.

SUMMARY OF THE INVENTION

The present invention has been made in view of such themes. An object is therefore to provide a compact hydraulic actuator at low cost. Another object is to improve the response characteristics and reliability of a hydraulic actuator. A further object is to use a hydraulic actuator as drive means for a variable valve driving mechanism and to arrange the hydraulic actuator at a position appropriate in view of its installation space and mounting man-hour.

A hydraulic actuator according to the present invention therefore comprises:

a housing with an oil compartment formed therein;

a power output shaft rotatably supported on the housing and extending out from an interior of the oil compartment to an exterior of the housing;

a vane extending out from the power output shaft at a portion thereof, which is located within the oil compartment, in a direction radial relative to an axis of the power output shaft and maintained in contact with an inner wall of the oil compartment, whereby the vane divides the oil compartment into a first oil compartment and a second oil compartment;

a first hydraulic pressure passage communicating the first oil compartment and a hydraulic pressure source with each other;

a second hydraulic pressure passage communicating the second oil compartment and the hydraulic pressure source with each other; and an oil control valve regulating at least one of a first hydraulic pressure to be supplied to the first oil compartment through the first hydraulic pressure passage and a second hydraulic pressure to be supplied to the second oil compartment through the second hydraulic pressure passage;

wherein the power output shaft is specified in its rotated position by the first and second hydraulic pressures acting on the vane.

Owing to this construction, the oil compartment and the oil control valve can be assembled together, leading to an advantage that the hydraulic actuator can be compact. There is another advantage that the hydraulic response characteristics and reliability of the actuator can be improved while its manufacturing cost can be kept low.

Preferably, the first hydraulic pressure passage may comprise a first supply passage for supplying working oil from the hydraulic pressure source to the first oil compartment and a first return passage for returning the working oil from the first oil compartment to the hydraulic pressure source; and the second hydraulic pressure passage may comprise a second supply passage for supplying working oil from the hydraulic pressure source to the second oil compartment and a second return passage for returning the working oil from the second oil compartment to the hydraulic pressure source.

This construction makes it unnecessary to arrange return passages outside the housing, thereby bring about an advantage that the manufacturing cost can be kept low.

The oil compartment may preferably be provided with:

a semicylindrical outer periphery with which an extended end of the vane is maintained in contact; and two limiting walls arranged on opposite angular ends of the outer periphery, respectively, so that the limiting walls limit a rotatable range of the vane.

This construction makes it possible to form the hydraulic actuator in a smaller size, thereby bring about advantages that the manufacturing cost can be kept low and the required installation space can be reduced.

Preferably, the oil control valve may be arranged within the housing, and is located on a side opposite to the oil compartment with the limiting walls interposed therebetween.

Owing to this construction, the first and second hydraulic pressure passages can be shortened, leading to an advantage that the response characteristics of the actuator can be improved. It is also possible to prevent oil leakage from the oil compartment during a standstill of the engine. This can advantageously contribute to the prevention of a response deterioration in controlling the vane and also to an improvement in the reliability of the hydraulic actuator.

The control valve may preferably be located within an imaginary cylinder drawn about the power output shaft as a central axis with the vane as a radius.

This construction has an advantage that the hydraulic actuator can be constructed smaller.

Preferably, the hydraulic actuator may further comprise an urging member for urging an extended end of the vane against an inner wall of the oil compartment.

This construction has an advantage that the hydraulic actuator can be provided with higher reliability.

The urging member may preferably comprise:

a groove formed in the power output shaft and receiving the vane therein; and a spring interposed between a bottom portion of the groove and a basal end of the vane.

This construction has an advantage that the hydraulic actuator can be constructed compact with higher reliability while keeping the manufacturing cost low.

The urging member may preferably comprise:

a groove formed in the power output shaft and receiving the vane therein; and an oil passage communicating the hydraulic pressure source and a bottom portion of the groove with each other.

This construction has an advantage that the hydraulic actuator can be constructed compact with higher reliability while keeping the manufacturing cost low.

The vane may preferably be a single vane. This construction has an advantage that the hydraulic actuator can be constructed compact with higher reliability while keeping the manufacturing cost low.

Further, a hydraulically-driven variable valve driving mechanism according to the present invention for an internal combustion engine comprises:

a first shaft rotationally driven by a crankshaft of the internal combustion engine;

a second shaft for opening and closing a valve arranged in a combustion chamber of the internal combustion engine, said second shaft and said first shaft being coaxial with each other and rotatable relative to each other;

a speed-change adjusting mechanism for transmitting rotation of the first shaft to the second shaft with a phase of rotation of the second shaft being changed from a phase of the rotation of the first shaft;

a control member for adjusting rotation-phase-changing characteristics of the speed-change adjusting mechanism in accordance with a state of operation of the internal combustion engine; and a hydraulic actuator for driving the control member, said hydraulic actuator further comprising:

a housing with an oil compartment formed therein;

a power output shaft rotatably supported on the housing and extending out from an interior of the oil compartment to an exterior of the housing, said power output shaft being connected to the control member of the variable valve driving mechanism;

a vane extending out from the power output shaft at a portion thereof, which is located within the oil compartment, in a direction radial relative to an axis of the power output shaft and maintained in contact with an inner wall of the oil compartment, whereby the vane divides the oil compartment into a first oil compartment and a second oil compartment;

a first hydraulic pressure passage communicating the first oil compartment and a hydraulic pressure source with each other;

a second hydraulic pressure passage communicating the second oil compartment and the hydraulic pressure source with each other; and an oil control valve regulating at least one of a first hydraulic pressure to be supplied to the first oil compartment through the first hydraulic pressure passage and a second hydraulic pressure to be supplied to the second oil compartment through the second hydraulic pressure passage;

wherein the power output shaft is specified in its rotated position by the first and second hydraulic pressures acting on the vane, and the rotation-phase-changing characteristics of the speed change adjusting mechanism are determined depending on the rotated position of the power output shaft.

Owing to the above construction, the hydraulic actuator as the drive means for the variable valve driving mechanism of the internal combustion engine can be constructed compact. The variable valve driving mechanism can therefore be mounted within a limited installation space without enlarging the size of the internal combustion engine.

Preferably, the first shaft may be arranged with one end thereof projecting out of the internal combustion engine in an extending direction of the crankshaft, and the one end may be connected to the crankshaft via a power transmission mechanism.

This construction has an advantage that the variable valve driving mechanism of the internal combustion engine can be provided with high reliability.

Preferably, the internal combustion engine may be provided with a cylinder head defining a first bore and a second bore at opposite ends thereof, respectively, as viewed in the extending direction of the crankshaft, the one end of the first shaft may be arranged through the first bore, and the actuator may be arranged in the second bore.

Owing to this construction, it is not necessary to make an additional bore upon mounting the hydraulic actuator on the cylinder head. The hydraulic actuator can therefore be arranged while keeping the machining manhour low. There is hence an advantage that the installation procedure becomes easy.

BRIEF DESCRIPTION OF THE DRAWINGS

FIGS. 1(A) and 1(B) are cross-sectional views of a hydraulic actuator according to a first embodiment of the present invention taken in the direction of arrows I(A),I(B)—I(A),I(B), of FIG. 2, in which FIG. 1(A) illustrates a state in which a control member is driven toward a high-speed side and FIG. 1(B) depicts another state in which the control member is driven toward a low-speed side;

DESCRIPTION OF THE PREFERRED EMBODIMENTS

Preferred embodiments of the present invention will hereinafter be described.

First, a description will be made about the first embodiment. The hydraulic actuator according to this embodiment is arranged to drive a variable valve driving mechanism which controls operation of an intake valve or exhaust valve (which will hereinafter be collectively called the "valve") in a reciprocating internal combustion engine (hereinafter called the "engine"), especially controls the timings of its opening and closing.

Now, the variable valve driving mechanism of the internal engine will be described.

Figure 3:
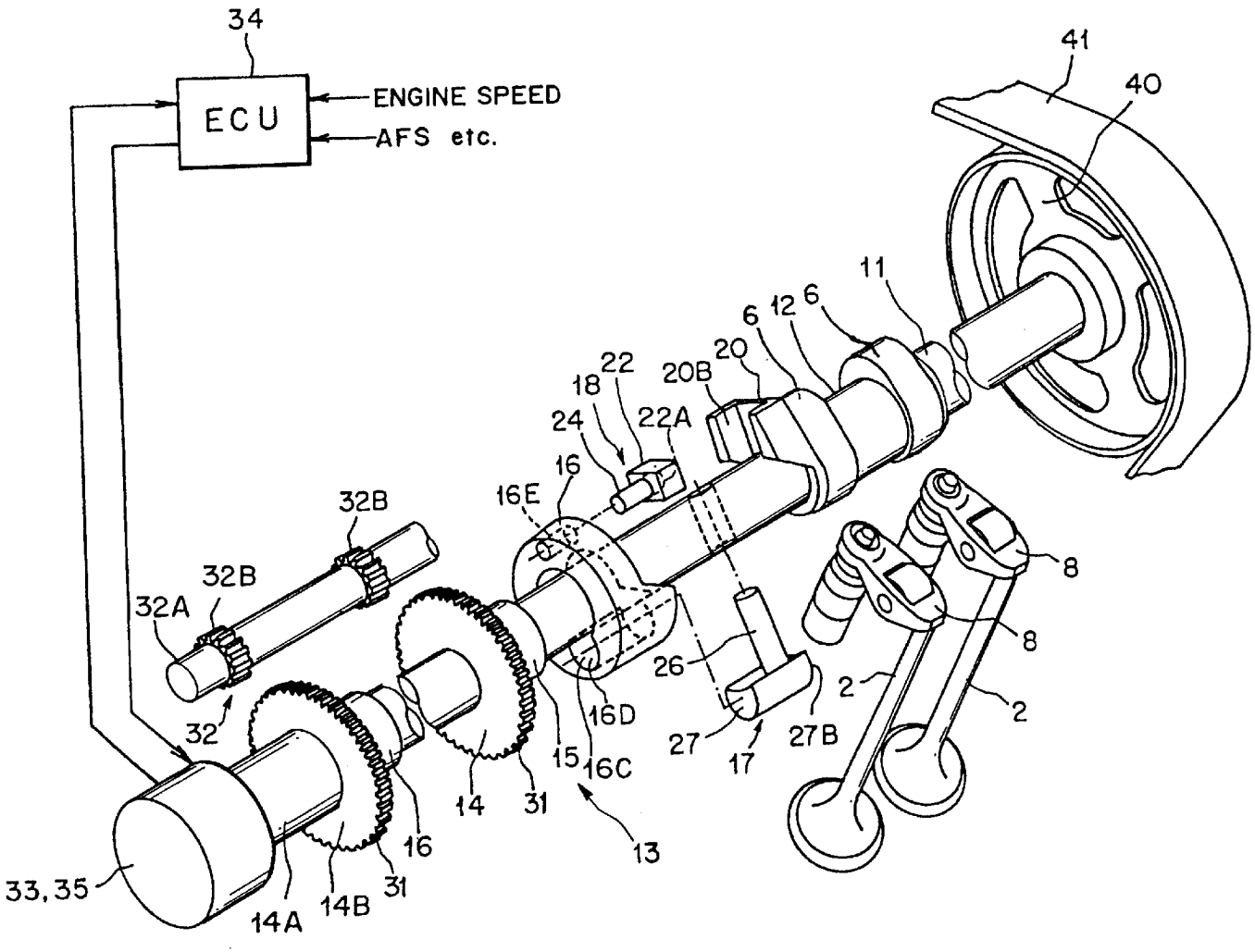
FIG. 3 is a schematic perspective view of the variable valve driving mechanism according to the first embodiment of the present invention for the internal combustion engine.

A cylinder head of a multicylinder engine (not shown) is provided with valves 2 as shown in FIG. 3, so that intake ports or exhaust ports are opened and closed. A cam 6 is maintained in contact with its corresponding valve 2, and by the cam 6, the valve 2 is driven in an opening direction against biasing force of a valve spring (not shown). Namely, a rocker arm (a roller rocker arm in this embodiment) 8 is arranged on a stem-side end portion of each valve 2, and the cam 6 rocks the rocker arm 8 to drive the valve 2 by its rocking end portion. The variable valve driving mechanism is arranged to modulate the rotating speed of the cam 6, which drives its corresponding valve as described above, so that the driving timing of the valve is controlled.

Figure 1A:
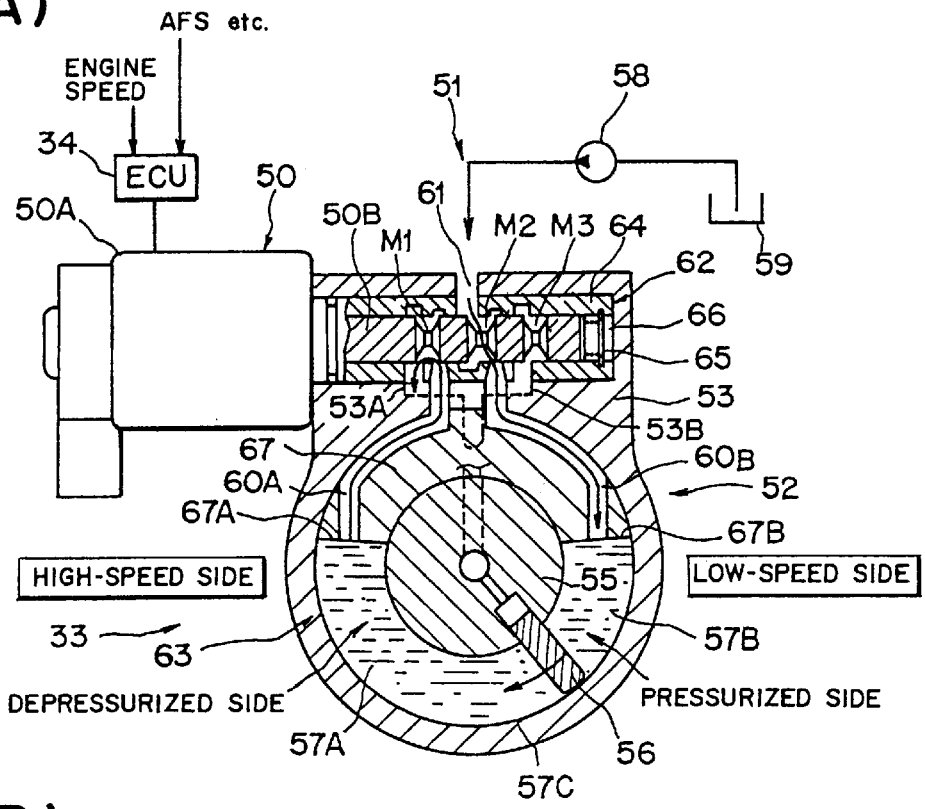
Figure 1B:
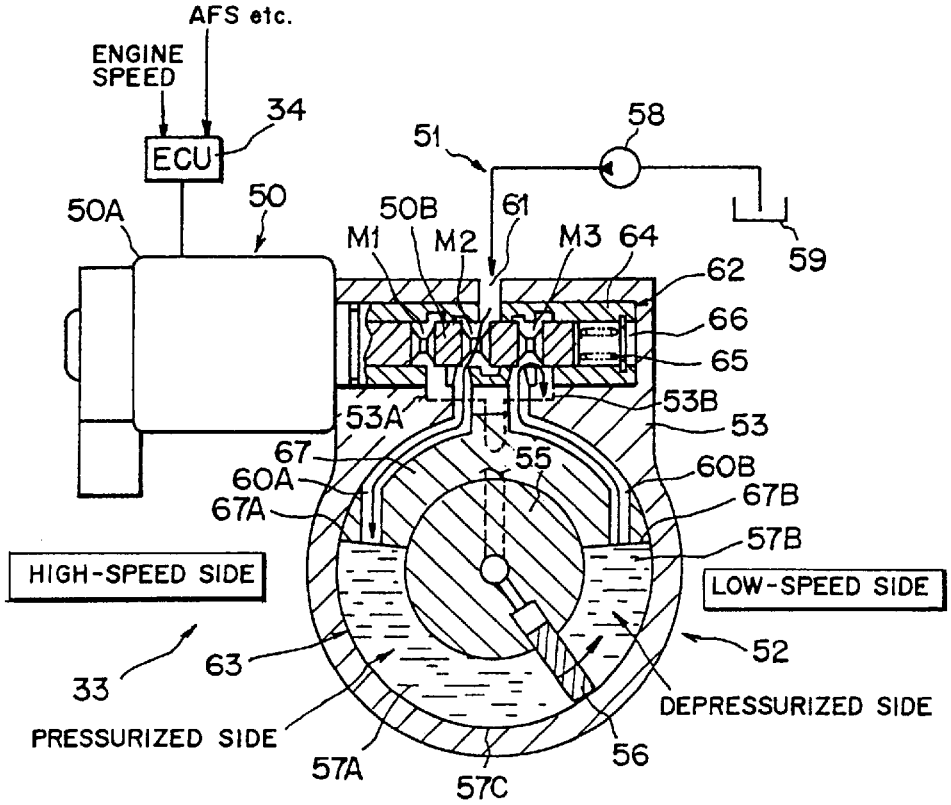
Figure 2:
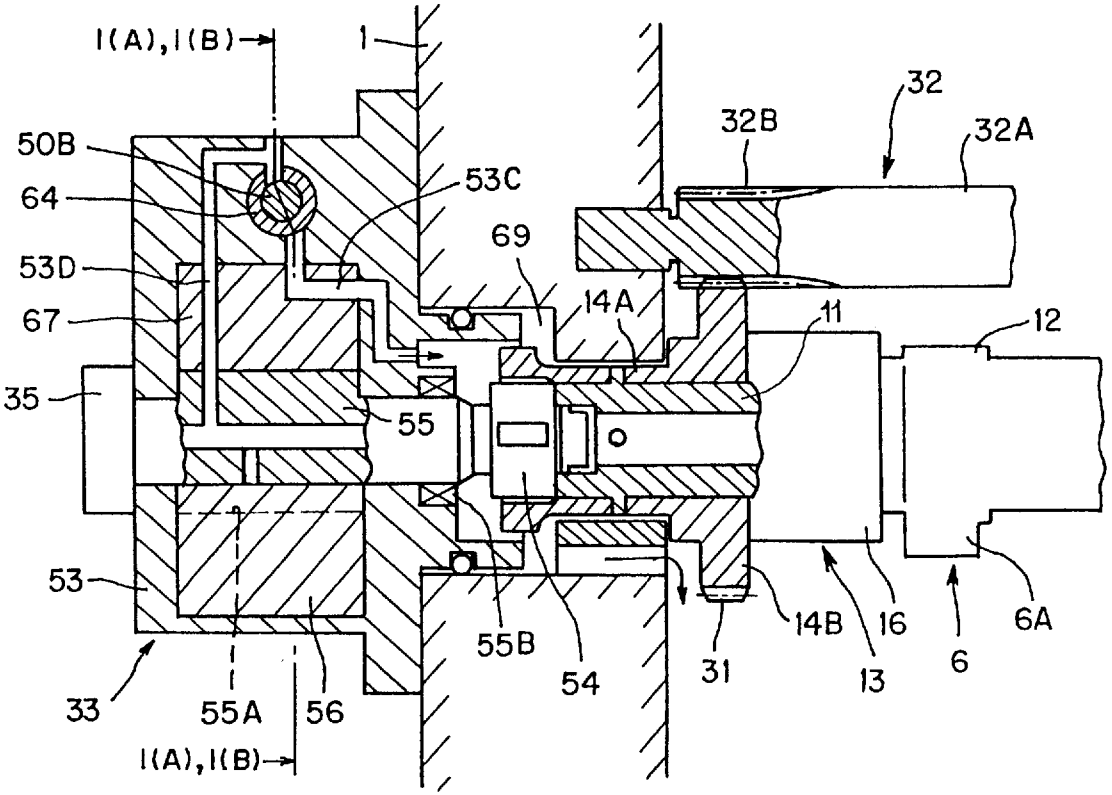
FIG. 2 is a schematic cross-sectional view of the hydraulic actuator according to the first embodiment of the present invention and a variable valve driving mechanism for an internal combustion engine, the variable valve driving mechanism being driven by the hydraulic actuator.

The variable valve driving mechanism is provided, as shown in FIG. 1 and FIG. 2, with a camshaft (first shaft) 11, which is rotatedly driven in association with a crankshaft (not shown) of the engine, and also with a cam lobe (second shaft) 12 arranged on an outer periphery of the camshaft 11. The cam 6 is arranged on an outer periphery of the cam lobe 12 so that the cam extends out from the outer periphery.

This camshaft 11 is arranged extending from one end to the other end of a cylinder head 1 in its longitudinal direction, so that the camshaft 11 extends along central axes of paired bores (first bore and second bore) formed with a common axis on each side of the cylinder head 1, respectively. As shown in FIG. 3, the camshaft 11, on a side of one end thereof, extends out of the cylinder head through the unillustrated bore (first bore). This externally-extending one end portion is connected to the crankshaft via a power transmission mechanism, that is, a sprocket (pulley) 40 and a pulley belt 41 wrapped on the sprocket 40, so that the camshaft 11 is rotatedly driven in association with the crankshaft.

Further, each cylinder is provided with the cam lobe 12, which is externally fitted on the camshaft 11 so that the cam lobe 12 and the camshaft 11 are coaxial with each other and are rotatable relative to each other. Outer peripheries of the camshaft 11 and cam lobe 12 are rotatably supported by a journal bearing (not shown) arranged on a side of the cylinder head 1.

Further, each cylinder is provided with a nonuniform speed coupling 13 which is disposed as a speed-change adjusting mechanism between the camshaft 11 and the cam lobe 12. This nonuniform speed coupling 13 is provided with a control gear 14 rotatably supported on the outer periphery of the camshaft 11, an eccentric portion 15 arranged integrally with the control gear 14, an engaging disk 16 rotatably supported as an engaging member relative to the eccentric portion 15 on a cylindrical outer periphery of the eccentric portion 15, and a first slider member 17 and second slider member 18 connected to the engaging disk 16.

Formed in one side of the engaging disk 16, as illustrated in FIG. 3, is a bore 16D for the attachment of the first slider member 17 and another bore 16E for the attachment of the second slider member 18.

The first slider member 17 is composed of a projecting pin member 26 as a first connecting portion, which is arranged projecting from the camshaft 11, and a drive arm 27 which engages with the engaging disk 16.

The projecting pin member 26 is arranged on the camshaft 11 so that the projecting pin member 26 extends in a radial direction.

The drive arm 27, on the other hand, is provided on an outer periphery thereof with a cylindrical outer periphery 27B as shown in FIG. 3. An inner periphery of the bore 16D is formed of a cylindrical inner periphery 16C which corresponds to the cylindrical outer periphery 27B, and the drive arm 27 is fitted in the bore 16D. The drive arm 27 is allowed to rotate within the bore 16D with the cylindrical outer periphery 27B maintained in sliding contact with the cylindrical inner periphery 16C.

On the other hand, the second slider member 18 is arranged with its phase offset (through 180° in this embodiment) relative to the drive arm 27 of the first slider member 17 to avoid any interference with the first slider member 17. The second slider member 18 is composed of a slider main body 22 and a drive pin 24 as a pin member, the slider main body 22 is maintained in radially-slidable engagement with a slider groove 20B formed in an arm portion 20 of the cam lobe 12, and the drive pin 24 is fitted at one end portion thereof in the bore 16E formed in the engaging disk 16 and at an opposite end portion thereof in a bore 22A formed in the slider main body 22. Further, the drive pin 24 is rotatable relative to the bore 16E or the bore 22A.

Accordingly, rotation of the engaging disk 16 causes the drive pin 24 of the second slider member 18 and the slider member 22 to rotate integrally with the engaging disk 16, and this rotating force is transmitted from the slider main body 22 to the side of the cam lobe 12 via the slider groove 20B and the arm portion 20.

In the nonuniform speed coupling 13, rotation of the camshaft 11 is therefore transmitted from the projecting pin member 26 to the engaging disk 16 via the drive arm 27 and the bore 16D and further, from the arm portion 20 to the cam lobe 12 via the bore 16E, the drive pin 24, the bore 22A and the slider main body 22.

Upon transmitting rotation as described above, because of the eccentricity of the engaging disk 16 relative to the camshaft 11, the engaging disk 16 is repeatedly advanced and retarded relative to the camshaft 11 and the cam lobe 12 is repeatedly advanced and retarded relative to the engaging disk 16, so that the cam lobe 12 rotates at speeds not equal to the camshaft 11.

Based on FIGS. 4(A) to 4(D), a description will now be made about the phases of rotation of the engaging disk 16 and cam lobe 12 so that their phases of rotation correspond to the individual phases of rotation of the camshaft 11 (camshaft angles)

Figure 4B:
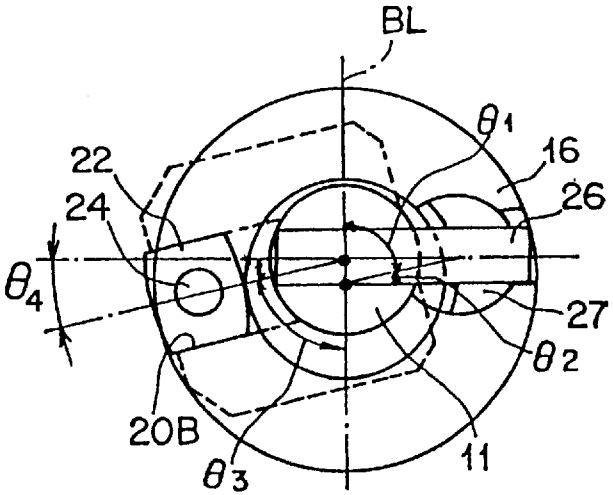
FIGS. 4(A) through 4(D) are cross-sectional views showing an operation of a nonuniform speed mechanism in the variable valve driving mechanism according to the first embodiment of the present invention for the internal combustion engine, in which the operation proceeds in the order of FIG. 4(A) to FIG. 4(D)
Figure 4A:
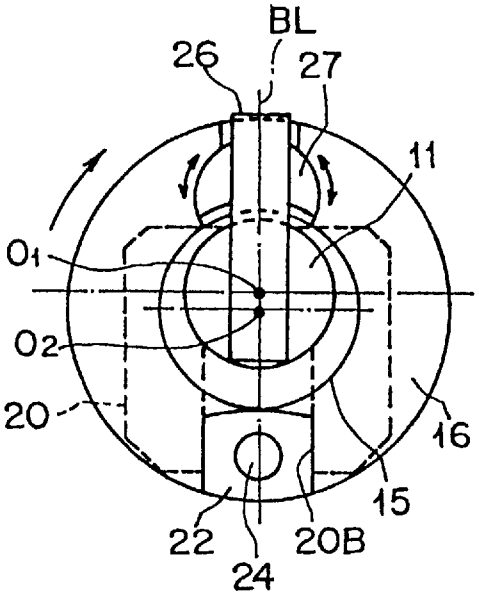

As is illustrated in FIG. 4(A), when the camshaft 11 rotates clockwise from a camshaft angle of 0° as a base position to a camshaft angle of 90° as indicated by an arrow, the engaging disk 16 and cam lobe 12 have undergone displacements as depicted in FIG. 4(B).

The above mentioned feature of the nonuniform speed coupling is disclosed in International Application PCT/JP96/01390, in which the U.S. is designated. The entire disclosure of PCT/JP96/01390 filed on Mar. 24, 1996, including its specification, claims drawings and summary are incorporated herein by reference in its entirety.

Namely, owing to the eccentricity of the engaging disk 16, an angular displacement $\theta_1$ of the engaging disk 16 is smaller than an angular displacement (=90°) of the camshaft 11 and an angular displacement $\theta_2$ is still smaller than the angular displacement $\theta_1$ of the engaging disk 16. Accordingly, while the camshaft rotates through 90° from the camshaft angle of 0° to the camshaft angle of 90°, the cam lobe 12 rotates at a lower speed than the cam shaft 11.

Figure 4D:
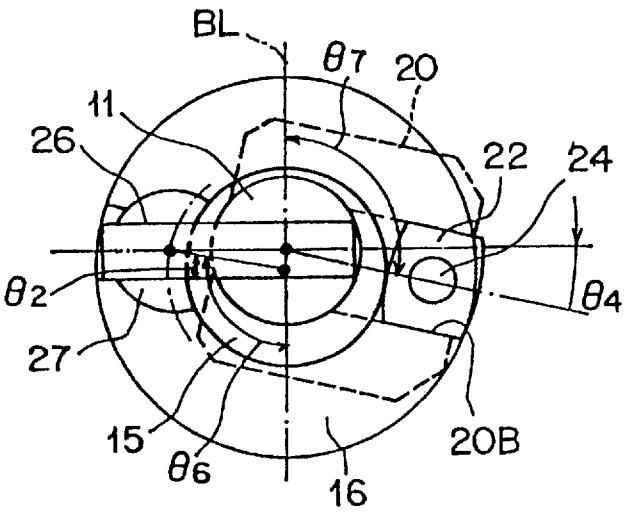
Figure 4C:
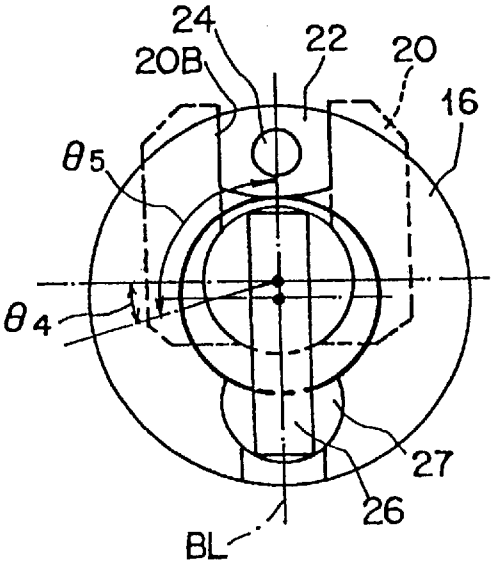

When the camshaft 11 next rotates through 90° from the camshaft angle of 90° to a camshaft angle of 180°, the pin member 26 assumes a position such as that shown in FIG. 4(C). As opposed to the rotation of the camshaft 11 through 90° only, the cam lobe 12 undergoes only an angular displacement $\theta_5$ (=90°+$\theta_4$). During this period, the cam lobe 12 rotates at a higher speed than the camshaft 11.

When the camshaft 11 rotates further through 90° from the camshaft angle of 180° to a camshaft angle of 270°, the pin member 26 assumes a position such as that illustrated in FIG. 4(D) so that the engaging disk 16 has undergone an angular displacement $\theta_6$ which is greater by an angle $\theta_2$ than the angular displacement (=90°) of the camshaft 11. Further, a displacement $\theta_7$ of the cam lobe 12 is still greater than the angular displacement $\theta_6$ of the engaging disk 16. Accordingly, while the camshaft 11 rotates through 90° from the camshaft angle of 180° to the camshaft angle of 270°, the cam lobe 12 rotates at a higher speed than the camshaft 11.

When the camshaft 11 rotates still further through 90° from the camshaft angle of 270° to a camshaft angle of 360 (=0°), the drive pin 23 again assumes a position such as that illustrated in FIG. 4(A). As opposed to the rotation of the camshaft 11 through 90° only, the cam lobe 12 undergoes only an angular displacement $\theta_5$ (=90°−$\theta_4$). During this period, the cam lobe 12 rotates at a lower speed than the camshaft 11.

As has been described above, the cam lobe 12 is advanced and retarded relative to the camshaft 11 and can rotate at speeds not equal to the speeds of rotation of the camshaft 11, the camshaft 11 can be rotated while adjusting the eccentric position (the phase of the eccentric center) of the engaging disk 16 by rotating the control gear 14 through a hydraulic actuator 33.

Using the characteristic that the cam lobe 12 is advanced and retarded relative to the camshaft 11 as described above, the opening and closing time of the valve can be adjusted.

The degree of such a phase deviation of the cam lobe 12 relative to the camshaft 11 can be adjusted by changing the position of the eccentric center $O_2$ of the eccentric portion 15 which is arranged integrally with the control gear 14.

Figure 5:
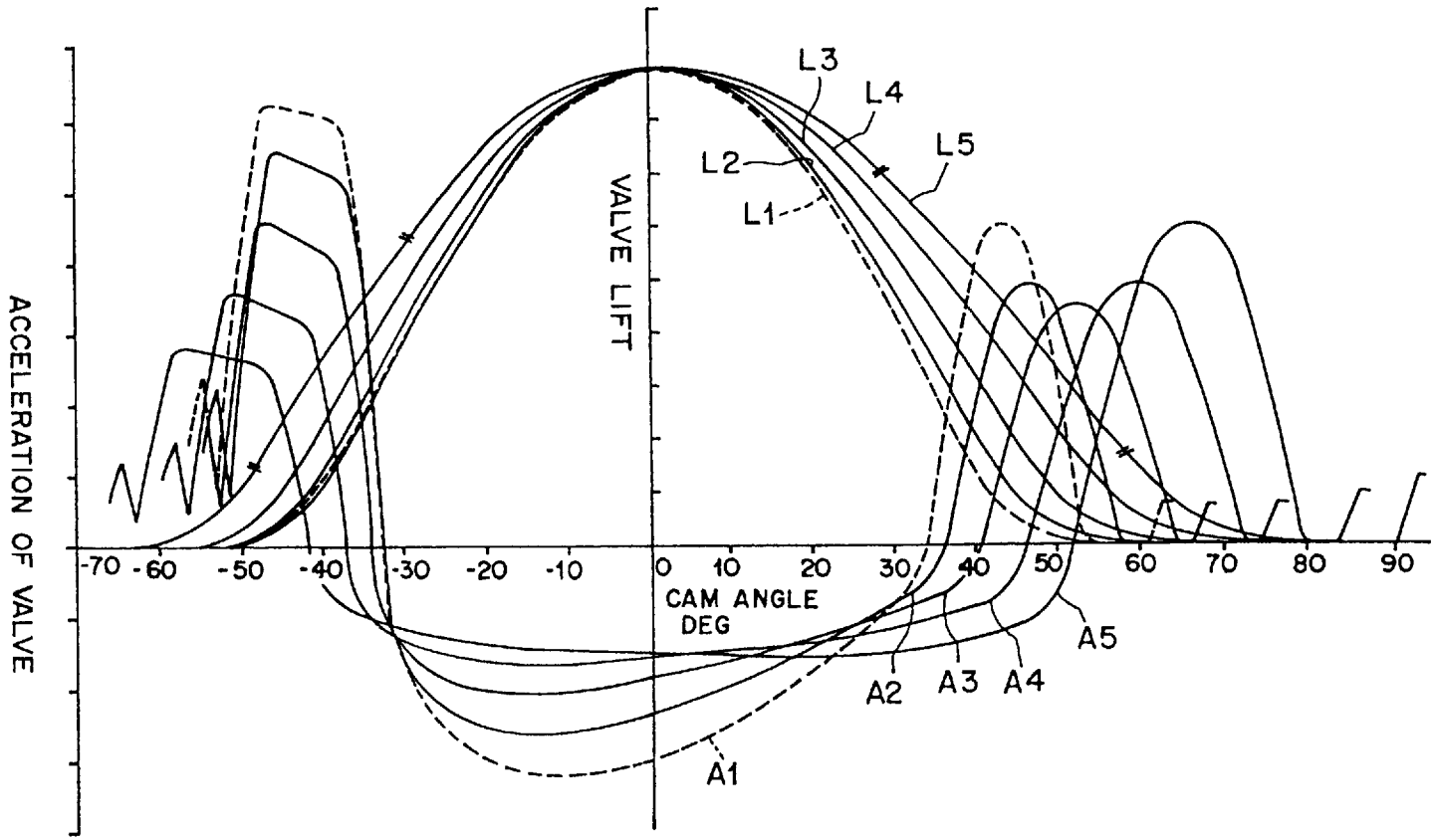
FIG. 5 is a diagram showing valve lift characteristics as adjusted in eccentric position by the variable valve driving mechanism according to the first embodiment of the present invention for the internal combustion engine.

Reference is now had to FIG. 5, which diagrammatically illustrates valve lift characteristics corresponding to eccentric positions (positions of the eccentric portion 15 about the eccentric center $O_2$) adjusted by the variable valve driving mechanism. Incidentally, curves valve A1 to A5 indicate acceleration characteristics of the valve, which correspond to valve lift characteristics L1 to L5.

As is shown in FIG. 5, when the engine is at a high speed or under a high load, the phase of rotation of the control gear 14 is adjusted to have, for example, valve lift characteristics like the curve L4 or L5 in FIG. 5, so that the variable valve driving mechanism is controlled to make longer the open period of the valve. On the other hand, when the engine is at a low speed or under a low load, the phase of rotation of the control gear 14 is adjusted to have, for example, valve lift characteristics like the curve L1 or L2 in FIG. 5, so that the variable valve driving mechanism is controlled to make shorter the open period of the valve.

Here, the control of the variable valve driving mechanism is set in such a way that, when the phase of rotation of the control gear 14 is set at 0°, for example, the opening time is retarded, the closing time is advanced and the valve open period is hence rendered shorter as indicated by the curve L1 in FIG. 5 and that, when the phase of rotation of the control gear 14 is gradually advanced, the opening time of the valve is gradually advanced, its closing time is gradually retarded and the valve open period is hence rendered gradually longer as indicated by the curves L2, L3, L4 and L5 in FIG. 5. Such control can be achieved by controlling the phase of the control gear 14 in a rotation range of 180°.

To perform a phase adjustment (phase angle control) of the eccentric portion 15 by rotating the control gear 14, the hydraulic actuator 33 is thus arranged as shown in FIG. 2 and FIG. 3. It is also designed that changing characteristics of the phase of rotation of the control gear 14 be determined in accordance with the rotated position of a power output shaft 55 of the hydraulic actuator 33.

A description will now be made about the hydraulic actuator for driving the variable valve driving mechanism.

FIGS. 1(A) and 1(B) are schematic cross-sectional views showing the hydraulic actuator for driving the variable valve driving mechanism, and FIG. 2 is a vertical cross-sectional view of the hydraulic actuator and the variable valve driving mechanism driven by the hydraulic actuator.

The hydraulic actuator 33 is arranged to drive a control disk (control member) 14B which is rotatably arranged on an end portion of the camshaft 11. As is illustrated in FIGS. 1(A) and 1(B), the hydraulic actuator 33 is provided with a hydraulic pressure supply means (hydraulic pressure source) 51, which has an oil control valve 50, and an actuator main body 52.

By controlling the oil control valve 50 of the hydraulic pressure supply means 51, the hydraulic actuator 33 adjusts a state of supply of working oil so that a vane 56 is reciprocally rotated about its axis to rotatedly drive the control disk 14B. In this embodiment, a single-vane hydraulic actuator is used as the hydraulic actuator 33 as depicted in FIGS. 1(A) and 1(B).

The actuator main body 52 is composed, as shown in FIGS. 1(A), 1(B) and 2, of a housing 53 having a drain passage (first return flow passage) 53A and a drain passage (second return flow passage) 53B, an Oldham coupling 54 as transmission means for transmitting rotating force to the control disk 14B, the power output shaft (control shaft) 55 extending to an outside of the housing 53 and connected to the Oldham coupling 53, a single vane 56 fitted in the power output shaft 55 and extending in a radial direction relative to an axis of the power output shaft 55, and a first oil compartment 57A and a second oil compartment 57B divided from each other by the vane 56.

Inside the housing 53, as illustrated in both FIG. 1(A) and FIG. 1(B), a space 62 is formed as a valve chest in an upper part to accommodate therein a spool valve 50B of the oil control valve 50 and in a lower part, another space 63 is formed as an oil compartment to and from which working oil is supplied and discharged. The valve chest space 62 can be formed by drilling a bore through the housing 53 along a central axis of the spool valve 50B, closing the bore at one end thereof by a casing of a main body, i.e., a driving solenoid portion 50A of the below-described oil control valve 50, and closing the bore at the opposite end thereof by an unillustrated cover member. The oil compartment space 63, on the other hand, can be formed by boring a large cylindrical hole through the housing 53 in a direction of a central axis of the cam lobe 12 [i.e., in a direction perpendicular to the drawing sheet of FIG. 1(A) and FIG. 1(B)], internally arranging a semicylindrical core member 67 and the power output shaft 55 in an upper part of the large cylindrical hole and then closing the cylindrical hole at opposite end portions thereof by cover members. In the housing 53, an inlet 61 is also formed to supply working oil therethrough. This inlet 61 is in communication with the valve chest 62.

In this embodiment, the valve chest space 62 is formed on the side of one end of the housing (on the upper side at the time of mounting) and the oil compartment space 63 is formed on the side of the opposite end (on the lower side at the time of mounting). The oil compartment space 63 may also be called simply the "oil compartment".

Disposed inside the valve chest space 62 is a hollow member 64 that forms a spool compartment in which the spool valve 50B of the oil control valve 50 is accommodated.

Inside the hollow member 64, a spring 65 and a spring retainer 66 are also arranged in addition to the spool valve 50B. Described specifically, the spring retainer 66 is attached to one end of the hollow member 64 and the spring 65 is arranged in a compressed state between the spring retainer 66 and the spool valve 50B, whereby the position of the spool valve 50B can be adjusted as desired by the urging force of the spring 65 and electromagnetic force from the solenoid portion 50A of the oil control valve 50.

The oil compartment space 63 is defined at an outer periphery thereof by an inner periphery of a semicylindrical outer peripheral wall 57C formed in a lower part of the housing 53, at an inner periphery thereof by the outer periphery of the power output shaft 55, and at peripheral ends thereof by lower end faces 67A,67B of the semicylindrical core member 67. Within the oil compartment space 63, the vane 56 extending form the power output shaft 55 is arranged with its free end portion maintained in contact with the inner periphery of the outer peripheral wall 57C, so that the oil compartment space 63 is divided by the vane 56 into the first oil compartment 57A and the second oil compartment 57B.

To communicate the valve chest space 62 and the oil compartment space 63 with each other, a first oil passage (on the left side as viewed in the drawings) 60A and a second oil passage (on the right side as viewed in the drawings) 60B are formed through the semicylindrical core member 67, and the first oil passage (first supply passage) 60A is in communication with the first oil compartment 57A and the second oil passage (second supply passage) 60B is in communication with the second oil compartment 57B.

These first oil passage 60A and second oil passage 60B are also in communication with the below-described oil pressure supply means, so that oil is supplied through these first oil passage 60A and second oil passage 60B.

Incidentally, the first hydraulic pressure passage is composed of the first oil passage 60A as the first supply passage and the drain passage 53A as the first return passage, and the second hydraulic pressure passage is composed of the second oil passage 60B as the second supply passage and the second drain passage 53B as the second return passage.

The semicylindrical first oil compartment 57A and second oil compartment 57B, which are divided from each other by the vane 56, have been formed by arranging the semicylindrical core member 67, the power output shaft 55 and the vane 56 within the oil compartment space 63 as described above. Further, limiting walls which define a rotatable range of the vane 56 are formed by the lower end faces 67A,67B of the semicylindrical member 67.

In this embodiment, the limiting walls composed of the lower end faces 67A,67B of the semicylindrical member 67 are constructed to directly limit rotation of the vane. Limitation of rotation of the vane 56 can also be effected by other rotation-limiting stoppers.

Incidentally, the vane 56 is rotated by the hydraulic pressure of working oil which is supplied to or discharged from the first oil compartment 57A and the second oil compartment 57B. In association with this rotation of the vane, the power output shaft 55 is rotatedly driven. To ensure sliding contact of the vane 56 with the outer peripheral wall 57C, the vane 56 is inserted at a basal end thereof in a groove 55A formed in the power output shaft 55, which is parallel to the axis thereof, and a portion of the working oil flowed in through the inlet 61 is supplied through an oil passage 53D to a position between the basal end of the vane 56 and a bottom portion of the groove 55A. The free end portion of the vane 56 is therefore pressed against the outer peripheral wall 57C of the semicylindrical first and second oil compartments 57A,57B.

The groove 55A and the oil passage 53D—which is arranged to communicate the bottom portion of the groove 55A and the hydraulic pressure supply means 51 with each other to supply working oil to the position between the basal end of the vane 56 and the bottom portion of the groove 55A—function as the "urging member" because they cause a portion of working oil to act on the basal end to urge the free end portion of the vane 56 toward the inner periphery of the outer peripheral all 57C. Both side walls of the vane 56 function as "pressure-acted surfaces" because the pressure of the working oil acts on them.

Accordingly, while supply of a hydraulic pressure through the spool valve 50B is stopped, the hydraulic pressure acting on the basal end of the vane 56 through the inlet 61 becomes higher so that the free end portion of the vane 56 can be surely pressed against the outer peripheral wall 57C. On the other hand, while supply of a hydraulic pressure through the spool valve 50B is performed, the hydraulic pressure at the inlet 61 varies somewhat to a lower side in response to the supply of the hydraulic pressure. Accordingly, the pressing force of the free end portion of the vane 56 against the outer peripheral wall 57C is lowered and the friction of the free end portion of the vane 56 with the outer peripheral wall 57C of the free end portion of the vane 56 is reduced, thereby bringing about an advantage that driving of the vane 56 is facilitated.

Further, the power output shaft 55 is provided at the end portion thereof with a position sensor 35. From a phase of rotation of the power output shaft 55, a phase of rotation of the control disk 14B can therefore be detected.

This position sensor 35 is constructed, for example, of a variable resistor or the like. As the position sensor 35 is attached directly to the power output shaft 55 of the hydraulic actuator 33, detection of a resistance corresponding to an angular displacement of the power output shaft 55 makes it possible to detect an angle of the power output shaft 55.

This power output shaft 55 is connected to the control gear 14 of each cylinder via the control disk 14B and the gear shaft 32A. The position sensor 35 can therefore detect an angle of the control gear 14.

Inside the housing 53, the drain passages 53A,53B are formed above the first oil compartment 57A and second oil compartment 57B. As shown in FIG. 2, these drain passages 53A,53B are connected to the drain passage 53C so that drain oils from the first oil compartment 57A and second oil compartment 57B are returned to the side of the cylinder head 1. These drain passages 53A,53B are in communication with the below-described hydraulic pressure supply means 51 via the drain passage 53C, and the oil is hence returned through these drain passages 53A,53B.

In this embodiment, the drain passage 53C is arranged extending through the housing 53 outside the power output shaft 55. This drain passage 53C may however be arranged to extend through the power output shaft 55 as will be described subsequently in connection with the second embodiment.

The hydraulic pressure supply means 51, on the other hand, is arranged to supply oil (working oil), which has been delivered from an oil tank 59 by an oil pump 58, to the actuator main body 52. By the oil control valve 50, a state of supply of oil can be controlled. As has been mentioned above, the spool valve 50B of the oil control valve 50 is arranged within the housing 53 in such a way that the spool valve 50B is located on a side opposite to the first oil compartment 57A and the second oil compartment 57B with the lower end faces 67A,67B of the semicylindrical member 67 interposed as limiting walls between them.

The oil control valve 50 arranged in the hydraulic pressure supply means 51 is constructed of the solenoid portion 50A and the spool valve 50B. By supplying a voltage across the solenoid portion 50A, the spool valve 50B is driven.

Described specifically, based on a detection signal from the position sensor 35, a voltage is supplied across the solenoid portion 50A of the oil control valve by an electronic control unit (ECU) 34 so that the phase of rotation of the control gear 14 is brought into a desired state. As a consequence, the spool valve 50B is actuated.

Incidentally, ECU 34 is inputted with detection information (engine speed information) form an engine speed sensor (not shown), detection information (AFS information) from an air flow sensor (not shown), and the like. Based on these information, the control of the hydraulic actuator 33 is performed corresponding to the rotational speed and load of the engine.

Grooves M1,M2,M3 are formed in the spool valve 50B. By shifting these grooves M1,M2,M3 to the positions of the inlet 61, the first oil passage 60A and the second oil passage 60B, the inlet 61 and the first oil passage 60A or the second oil passage 60B can be connected together.

Set as drive modes of this spool valve 50B are a voltage-on mode in which the solenoid portion 50A of the oil control valve is actuated and a voltage-off mode in which the solenoid portion 50A of the oil control valve is not actuated.

In the voltage-on mode, a voltage is applied to the hydraulic pressure supply means 51 so that the solenoid portion 50A of the oil control valve is actuated. The spool valve 50B therefore advances rightwards as viewed in FIGS. 1(A) and 1(B), whereby a high-speed side drive mode shown in FIG. 1(A) is established. At this time, the groove M1 communicates the first oil passage 60A with the drain passage 53A, and the groove M2 communicates the second oil passage 60B with the inlet 61. As a result, oil is supplied to the second oil compartment 57B so that the vane 56 is caused to move toward the high-speed side. In this case, the rotated position of the vane 56 is defined by a pressure balance between the first hydraulic pressure in the first oil compartment 57A and the second hydraulic pressure in the second oil compartment 57B. This defines the rotated position of the power output shaft 55.

In the voltage-off mode, on the other hand, the solenoid portion 50A of the oil control valve is no longer actuated. By the spring 65, the spool valve 50B therefore moves leftwards as viewed in FIGS. 1(A) and 1(B), whereby a low-speed side drive mode shown in FIG. 1(B) is established. At this time, the groove M3 communicates the second oil passage 60B with the drain passage 53A, and the groove M2 communicates the first oil passage 60A with the inlet 61. As a result, oil is supplied to the first oil compartment 57A so that the vane 56 is caused to move toward the low-speed side. In this case, the rotated position of the vane 56 is defined by the pressure balance between the first hydraulic pressure in the first oil compartment 57A and the second oil pressure in the second oil compartment 57B. This defines the rotated position of the power output shaft 55.

In this variable valve driving mechanism, the position of the spool valve 50B is duty-controlled. The spool valve 50B moves toward the high-speed side when the duty ratio is increased, and the spool valve 50B moves toward the low-speed side when the duty ratio is decreased. To hold the spool valve 50B stationary in its desired position, it is only necessary to adjust the duty ratio by feedback control on the basis of a detection signal from the position sensor 35.

The term "low-speed side" as used herein means a position of the vane 56, which position corresponding to a low engine speed. At this time, the control gear 14 for each cylinder is adjusted so that valve timing characteristics suited for low-speed rotation of the engine are obtained. On the other hand, the term "high-speed side" as used herein means a position of the vane 56, which position corresponding to a high engine speed. At this time, the control gear 14 for each cylinder is adjusted so that valve timing characteristics suited for high-speed rotation of the engine are obtained. In practice, the control gear 14 for each cylinder is adjusted to an appropriate position between the most low-speed side and the most high-speed side in accordance with the engine speed and engine load.

In this embodiment, at the time of a low speed, that is, at the time of an engine start-up or at the time of a low engine speed, the position of the vane 56 is set to move toward the right-most side as viewed in FIG. 1(A) and FIG. 1(B) so that the valve open period becomes shorter based on a phase difference between a phase of rotation of the camshaft 11 and a phase of rotation of the cam lobe 12. To adjust the timings of opening and closing of the valve to the high-speed side, the position of the vane 56 is set to move toward the left-most side as viewed in FIG. 1(A) and FIG. 1(B) so that the valve open period becomes longer based on the phase difference between the phase of rotation of the camshaft 11 and the phase of rotation of the cam lobe 12.

Further, this variable valve driving mechanism is set in such a way that, when a supply of electric power to the solenoid portion 50A of the oil control valve 50 is stopped, the urging force of the spring 65 becomes dominant and makes the spool valve 50B assume a position to drive the vane 56 toward the low-speed side, that is, makes the groove M2 assume a position to be connected to the inlet 61 and the first oil passage 60A.

At the time of a start-up of the engine, the low-speed side is generally suited for the timings of opening and closing of each valve. Setting of the spool valve 50B as described above, that is, setting of the spool valve 50B to assume an oil supply position corresponding to low-speed side timings of opening and closing of the valve during stoppage of electric supply to the solenoid portion 50A of the oil control valve 50 does not require driving the spool valve 50B at the time of a start-up. The above-mentioned setting can therefore simplify the control at the time of an engine start-up and the like. Needless to say, this setting does not consume electricity for the above purposes, leading to an improvement in gas mileage.

The hydraulic actuator 33 according to this embodiment is constructed as described above and, as depicted in FIG. 2, is arranged in a bore (second bore) formed beforehand on the opposite side of the cylinder head. Described specifically, the power output shaft 55, which the hydraulic actuator 33 is provided with, extends through the bore 69. This power output shaft 55 is connected to a hollow portion 14A of the control disk by way of the Oldham coupling 54 as transmission means, whereby driving of the control disk 14B by the hydraulic actuator 33 can be performed. At an end portion of the camshaft 11, the engaging disk 16 is arranged between the control disk 14B and the cam lobe 12. Further, the control disk 14B is externally fitted on the end portion of the camshaft 11 so that they can rotate relative to each other. Incidentally, designated at sign 55B in FIG. 2 is an oil seal arranged on an outer periphery of the power output shaft 55, and the power output shaft 55 is rotatably supported on the housing 53 via the oil seal 55B.

In this embodiment, the Oldham coupling 54 is used as means for connecting the power output shaft 5 and the hollow portion 14A of the control gear with each other to permit transmission of power therebetween. The transmission means is however not limited to it, and they may also be connected together, for example, by fitting them together or by interposing a rotation-preventing pin between them.

Use of a detachable Oldham coupling as the transmission means as in this embodiment can improve the mountability of the hydraulic actuator.

In this variable valve driving mechanism, the hydraulic actuator 33 is arranged in the bore 69 formed in the end portion of the cylinder head at the same time as the machining of a bore for a bearing of the camshaft 11 although the bore has heretofore been closed by a cap without arranging anything there. It is therefore unnecessary to form any additional bore for the arrangement of the hydraulic actuator 33. The variable valve driving mechanism can therefore be installed by using the conventional cylinder head as is.

Incidentally, control gears, engaging disks, cam lobes, cams and the like are arranged as many as the number of cylinders so that the individual cylinders are provided with variable valve driving mechanisms of the same construction, respectively. Further, concerning each cylinder, the control gear 14 is in meshing engagement with a second gear 32B formed as a control member on a gear shaft 32A in a gear mechanism 32, which gear shaft 32A extending in parallel with the axis of rotation of the camshaft 11. By rotating the second gear 32B in the gear mechanism 32 via the first gear 31 formed on the outer periphery of the control disk 14B, the eccentric position of the eccentric portion 15 of the control gear 14 is changed via the gear shaft 32A to an eccentric position adjusting angle corresponding to an operation state of the internal combustion engine.

In this hydraulic actuator, the oil control valve 50 is arranged above the actuator main body 52 and the oil compartments 57A,57B in the actuator main body 52 are arranged below the center of rotation of the vane 56. These arrangements can be attributed to the reasons to be described below.

Namely, when an engine equipped with such a hydraulic actuator is not used for a long time, oil tends to be lost from its oil compartment through a drain, resulting in penetration of air into the oil compartment. Oil is non-compressive, while air is compressive so that its volume changes when compressed. Penetration of air into the oil compartment therefore deteriorates the response in vane control, thereby making it difficult to accurately obtain a target phase angle. This leads to a reduction in performance.

By arranging the oil compartments 57A,57B in the lower part and the actuator main body 52 in the upper part, the layout of the vane in the actuator is therefore made adequate to form the actuator into a structure resistant to the penetration of air. This can minimize the penetration of air into the oil compartments 57A,57B and can also facilitate bleeding of air.

Since the hydraulic actuator according to the first embodiment of the present invention is constructed as mentioned above, it can be operated as will be described hereinafter.

Arrows in FIG. 1(A) and FIG. 1(B) indicate flows of oil. To rotate and move the vane 56 clockwise, for example, the oil entered through the inlet 61 is guided to the second oil passage 60B by the spool valve 50B and is allowed to flow into the second oil compartment 57B, as is shown in FIG. 1(A). A hydraulic pressure of the oil therefore acts on the vane 56, so that the vane 56 is driven clockwise. The oil in an amount as much as the oil supplied into the second oil compartment 57B is hence discharged from the first oil compartment 57A, through the first oil passage 60A and the spool valve 50B, and then from the drain passage 53A. In this case, the oil within the second oil compartment 57B is pressurized, and the oil within the first oil compartment 57A is depressurized.

To rotate the vane 56 counterclockwise, on the other hand, the oil entered through the inlet 61 is guided to the first oil passage 60A by the spool valve 50B and is allowed to flow into the first oil compartment 57A, as is depicted in FIG. 1(B). A hydraulic pressure of the oil therefore acts on the vane 56, so that the vane 56 is driven counterclockwise. The oil in an amount as much as the oil supplied into the first oil compartment 57A is hence discharged from the second oil compartment 57B, through the second oil passage 60B and the spool valve 50B, and then from the drain passage 53B. In this case, the oil within the first oil compartment 57A is pressurized, and the oil within the second oil compartment 57B is depressurized.

In this manner, the vane 56 can be rotated and moved, thereby making it possible to rotate the power output shaft 55 and the control disk 14B. Namely, based on engine speed information, AFS information and the like, a rotated position of the control disk 14B (control gear 14) corresponding to the engine speed and load is set by ECU. Based on a detection signal from the position sensor 35, a supply of a voltage to the oil control valve 50 is performed so that the actually-rotated position of the control disk 14B becomes equal to the preset rotated position. The spool valve 50A is then operated to perform supply and discharge of the oil. As a consequence, it is possible to rotate and move the vane 56 and further to rotate the control disk 14B.

By rotating the control disk 14B as described above, the control gear 14 for each cylinder is rotated via the gear mechanism 32 so that the eccentric position of the eccentric portion 15 is changed. This makes it possible to adjust the timings of opening and closing of the valve as well as the open period of the valve.

According to this embodiment, the oil control valve 50 and the actuator main body 52 are integrally arranged within the single housing 53 so that the hydraulic actuator 33 is formed compact. There is accordingly an advantage that the hydraulic actuator can be dimensionally reduced as a whole.

Further, the first oil passage 60A and second oil passage 60B are formed short, leading to another advantage that the response is good.

In addition, the drain oil is returned into the cylinder head 1 through the drain passages 53A,53B arranged within the housing 53. There is hence a further advantage that the return oil can be effectively used for lubrication.

An adjustment in the eccentric position of the eccentric portion 15 is transmitted from the actuator main body 52, through the power output shaft 55, further via the control disk 14B and the gear mechanism 32, to the eccentric portion 15 of the control gear 14. The power output shaft 55 and the control disk 14B are connected together by the Oldham coupling 54, and an angle of rotation of the vane 56 and an angle of rotation of the camshaft 11 correspond to each other in a one-to-one relationship. Upon adjustment of the eccentric position, it is no longer required to consider a difference in the angle of rotation between the vane 56 and the camshaft 11, leading to a still further advantage that the adjustment of timings of opening and closing of the valve can be performed more accurately and the driving of the valve can be performed with adequate timings. Incidentally, use of a scissors gear as the gear mechanism 32 is preferred to avoid backlash.

In the hydraulic actuator according to this embodiment, the spool valve 50B of the oil control valve 50 is operated under the duty-control. It is also possible to control the position of the vane 56 by including a high-speed side mode, a low-speed side mode and a stop off mode for the driving of the spool valve 50B instead of relying upon such duty-control.

The hydraulic actuator according to this embodiment is provided with the single vane 56. However, it is also possible to arrange a plurality of vanes 56.

In the hydraulic actuator according to this embodiment, the first oil passage 60A and the second oil passage 60B are both adjusted by the oil control valve 50. However, it is also possible to adjust only one of the first oil passage 60A and the second oil passage 60B.

Figure 6:
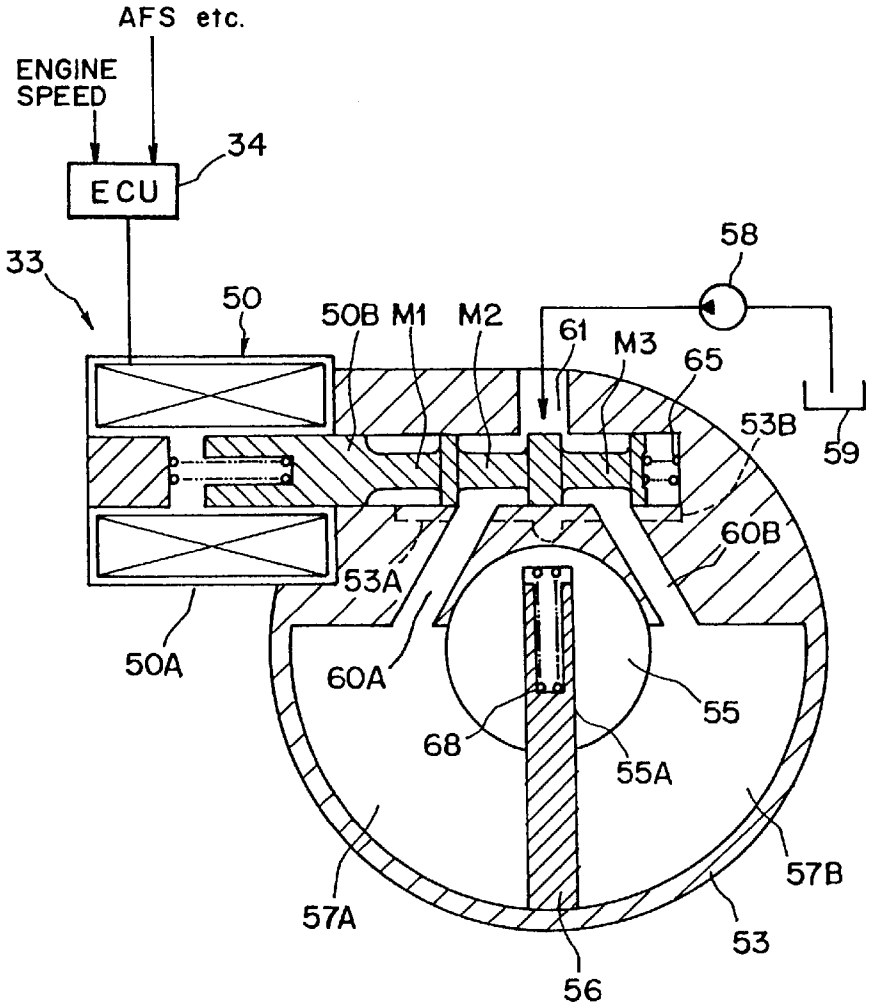
FIG. 6 is a cross-sectional view of a hydraulic actuator according to a second embodiment of the present invention taken in the direction of arrows VI—VI of FIG. 7.
Figure 7:
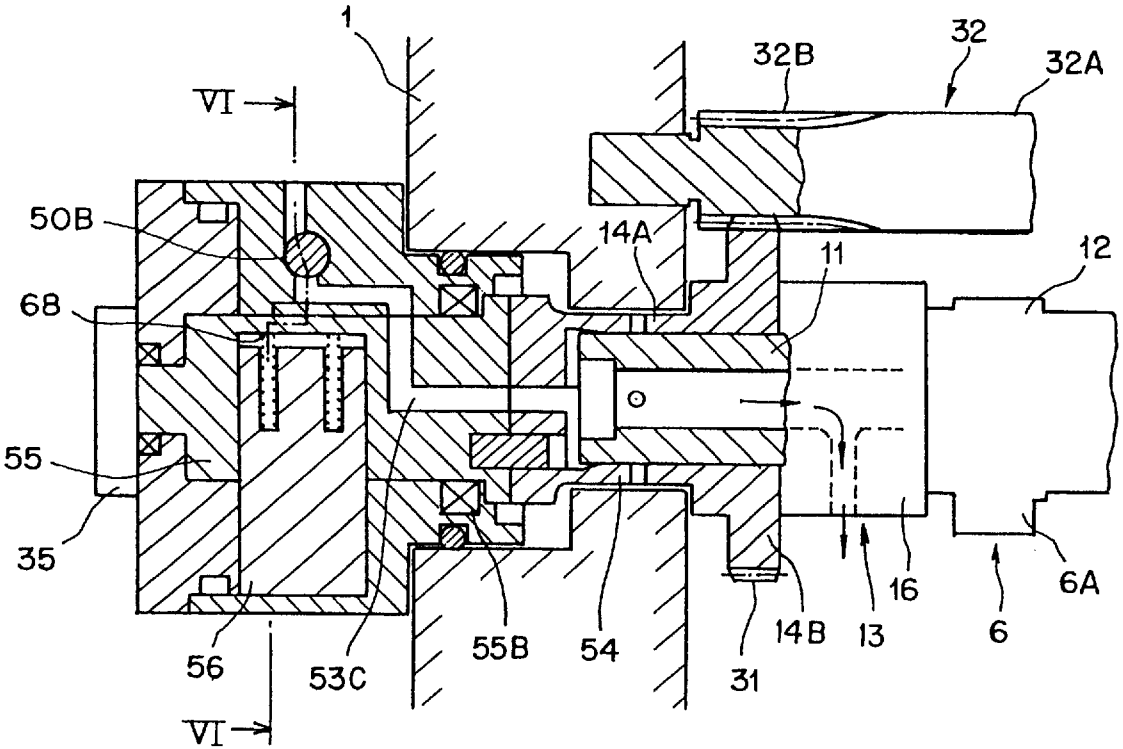
FIG. 7 is a schematic cross-sectional view of the hydraulic actuator according to the second embodiment of the present invention and a variable valve driving mechanism for an internal combustion engine, the variable valve driving mechanism being driven by the hydraulic actuator.
Figure 8:
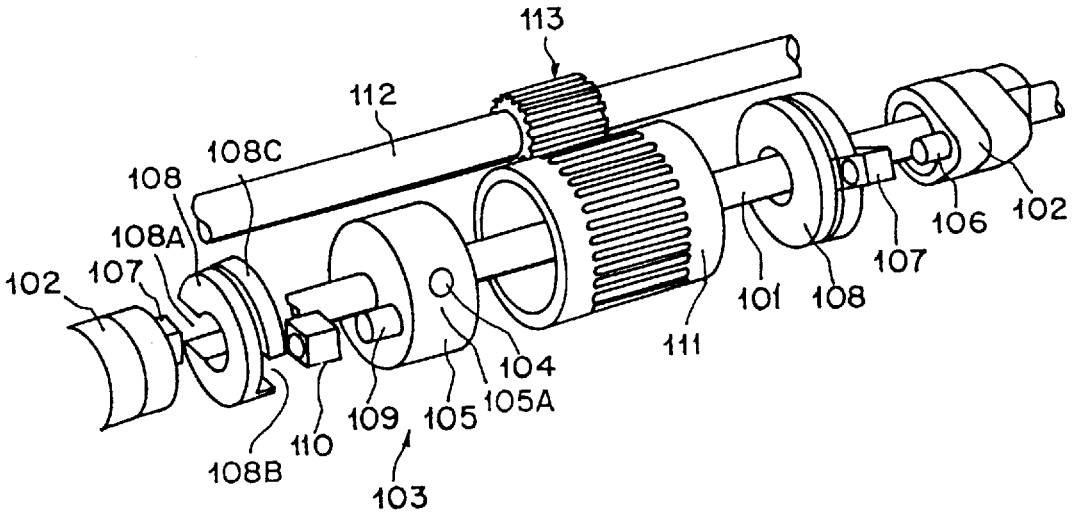
FIG. 8 PRIOR ART
FIG. 8 is a perspective view showing a conventional variable valve driving mechanism.
Figure 9:
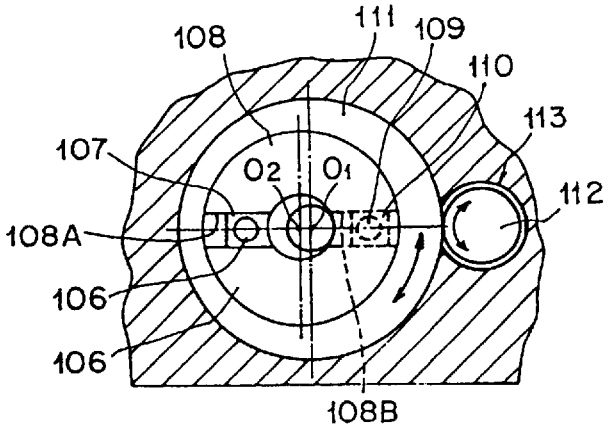
FIG. 9 PRIOR ART
FIG. 9 is a cross-sectional view showing the conventional variable valve driving mechanism.

A description will next be made about the second embodiment. As is illustrated in FIG. 6 and FIG. 7, the hydraulic actuator according to the second embodiment is different from the hydraulic actuator according to the first embodiment in that attachment of a vane to a power output shaft, drain passages and the overall actuator are constructed more compact.

In the second embodiment, a vane 56 is inserted at a basal end thereof in a groove 55A formed in a power output shaft 55, which is parallel to a central axis of the power output shaft 55. Between the basal end of the vane 56 and a bottom portion of the groove 55A, a spring 68 is interposed, so that the vane 56 is urged toward an outer peripheral wall 57C. Accordingly, the vane 56 is maintained at a free end portion thereof in contact with the outer peripheral wall 57C of a semicylindrical first oil compartment 57A and second oil compartment 57B.

The groove 55A formed in the power output shaft 55 and the spring 68 interposed between the basal end of the vane 56 and the bottom portion of the groove 55A serve to urge the vane 56 toward the outer peripheral wall. The groove 55A and the spring 68 function as the "urging member" collectively.

Further, a drain passage 53C is not arranged through a non-rotating portion inside a housing but is arranged to extend through the inside of the rotating power output shaft 55, and is connected to an oil passage formed inside a camshaft 11.

A spool valve 50B of a control valve 50 is attached on a side opposite to the semicylindrical first oil compartment 57A and second oil compartment 57B with the central axis of the power output shaft 55 located therebetween. In addition, the spool valve 50B is located within an imaginary cylinder drawn about the central axis of the power output shaft with the vane 56 as a radius.

Owing to the construction as described above, the hydraulic actuator according to the second embodiment can be operated in a similar manner as that of the first embodiment.

The control valve 50 is arranged close to the power output shaft 55 without using the semicylindrical core member 67 in the first embodiment. Accordingly, the hydraulic actuator according to the second embodiment can be constructed even smaller compared with that of the first embodiment. As the oil passages 60A,60B can be formed still shorter, the hydraulic actuator according to the second embodiment has another advantage that the response is excellent.

Further, the drain passage 53C is arranged inside the power output shaft 55 so that drain oil can be continuously used for the lubrication of elements (for example, the camshaft and the like) in the cylinder head. Moreover, a portion of the drain oil can also be used for the lubrication of the outer periphery of the power output shaft 55. A drive mechanism section, which is composed primarily of the vane 56 and the oil compartments 57A,57B and may also include the power output shaft 55 as needed, and a control mechanism section composed primarily of the spool valve 50B or the entire control valve 50 are accommodated within the integrated housing and are assembled together (in other words, are constructed as a single component). Therefore the hydraulic actuator is compact and is excellent in handling and mounting.

The application of the hydraulic actuator 33 according to each of the above-described embodiments is not limited to the variable valve driving mechanism of the same embodiment, but the hydraulic actuator 33 can also be applied to the variable valve driving mechanisms described in connection with the related art and the variable valve driving mechanisms disclosed in Japanese Patent Laid-Open Nos. 168309/1991 and 185321/1994. Its application to products other than variable valve driving mechanisms (for example, to industrial products with reciprocating louvers) can also be contemplated. Whatever product the actuator is applied to, its advantages of a small size and excellent response as an actuator can be effectively used.

Driving of the vane of the hydraulic actuator 33 is transmitted to the control gears 14 arranged for the respective cylinders by way of the control disk 14B, which is arranged at the end portion of the camshaft 11, and the gear mechanism 32, whereby the eccentric positions of the corresponding eccentric portions 15 are adjusted. As an alternative, it is also possible to arrange a gear directly on the power output shaft 55 and to directly drive the gear mechanism 32. Further, in the assembled hydraulic actuator according to each of the above-described embodiments as exemplified above as the hydraulic actuator 33, the housing in which the drive mechanism section and the control mechanism section are accommodated is not limited to one constructed integrally as a whole, and the housing may be one constructed in a complexly-divided form and integrated by fastening means such as bolts.

What is claimed is:

1. A hydraulic actuator, comprising:

a housing having an oil compartment and a valve receiving space therein, said housing having an insertion hole for inserting a valve from the outside of said housing;

a power output shaft rotatably supported by said housing and extending from an interior of said oil compartment to an exterior of said housing;

a vane extending from said power output shaft, within said oil compartment, in a radial direction relative to an axis of said power output shaft and maintained in contact with an inner wall of said oil compartment, said vane dividing said oil compartment into a first oil compartment and a second oil compartment;

a first hydraulic pressure passage communicating said first oil compartment and a hydraulic pressure source;

a second hydraulic pressure passage communicating said second oil compartment and said hydraulic pressure source; and an oil control valve having said valve, provided in said space, for regulating at least one of a first hydraulic pressure to be supplied to said first oil compartment through said first hydraulic pressure passage and a second hydraulic pressure to be supplied to said second oil compartment through said second hydraulic pressure passage, and an actuator, covering said insertion hole, for controlling said first valve, wherein said power output shaft is specified in its rotated position by said first and second hydraulic pressures acting on said vane.

2. A hydraulic actuator according to claim 1, wherein, said first hydraulic pressure passage includes a first supply passage for supplying oil from said hydraulic pressure source to said first oil compartment and a first return passage for returning said oil from said first oil compartment to said hydraulic pressure source, and said second hydraulic pressure passage includes a second supply passage for supplying oil from said hydraulic pressure source to said second oil compartment and a second return passage for returning said oil from said second oil compartment to said hydraulic pressure source.

3. A hydraulic actuator according to claim 1, wherein said oil compartment includes, a semicylindrical outer periphery with which an extended end of said vane is maintained in contact, and two limiting walls arranged on opposite angular ends of said outer periphery, respectively such that said limiting walls limit a rotatable range of said vane.

4. A hydraulic actuator according to claim 3, wherein said oil control valve is located on a side opposite to said oil compartment with said limiting walls interposed therebetween.

5. A hydraulic actuator according to claim 4, wherein said control valve is located within an imaginary cylinder drawn about said power output shaft as a central axis with said vane as a radius.

6. A hydraulic actuator according to claim 1, further comprising:

an urging member for urging an extended end of said vane against an inner wall of said oil compartment.

7. A hydraulic actuator according to claim 6, wherein said urging member includes, a groove formed in said power output shaft and receiving said vane therein, and a spring interposed between a bottom portion of said groove and a basal end of said vane.

8. A hydraulic actuator according to claim 6, wherein said urging member includes, a groove formed in said power output shaft and receiving said vane therein, and an oil passage communicating said hydraulic pressure source and a bottom portion of said groove.

9. A hydraulic actuator according to claim 1, wherein said vane is a single vane.

10. A hydraulically-driven variable valve driving mechanism for an internal combustion engine, comprising:

a first shaft rotationally driven by a crankshaft of said internal combustion engine;

a second shaft for opening and closing a valve arranged in a combustion chamber of said internal combustion engine, said second shaft and said first shaft being coaxial with each other and rotatable relative to each other;

a speed-change adjusting mechanism for transmitting rotation of said first shaft to said second shaft with a phase of rotation of said second shaft being changed from a phase of the rotation of said first shaft;

a control member for adjusting rotational-phase-changing characteristics of said speed-change adjusting mechanism in accordance with a state of operation of said internal combustion engine; and a hydraulic actuator for driving said control member, said hydraulic actuator including, a housing having an oil compartment and a valve receiving space therein, said housing having an insertion hole for inserting a valve from the outside of said housing, a power output shaft rotatably supported by said housing and extending out from an interior of said oil compartment to an exterior of said housing, said power output shaft being connected to said control member of said variable valve driving mechanism, a vane extending from said power output shaft, within said oil compartment, in a radial direction relative to an axis of said power output shaft and maintained in contact with an inner wall of said oil compartment, said vane dividing said oil compartment into a first oil compartment and a second oil compartment, a first hydraulic pressure passage communicating said first oil compartment and a hydraulic pressure source, a second hydraulic pressure passage communicating said second oil compartment and said hydraulic pressure source, and an oil control valve having said valve, provided in said space, for regulating at least one of a first hydraulic pressure to be supplied to said first oil compartment through said first hydraulic pressure passage and a second hydraulic pressure to be supplied to said second oil compartment through said second hydraulic pressure passage, and an actuator, covering said insertion hole, for controlling said first valve, wherein said power output shaft is specified in its rotated position by said first and second hydraulic pressures acting on said vane, and said rotational-phase-changing characteristics of said speed-change adjusting mechanism are determined depending on the rotated position of said power output shaft.

11. A variable valve driving mechanism according to claim 10, wherein said first shaft is arranged with a first end thereof projecting out of said internal combustion engine in an extending direction of said crankshaft, and said first end is connected to said crankshaft via a power transmission mechanism.

12. A variable valve driving mechanism according to claim 11, wherein said internal combustion engine is provided with a cylinder head, said first end of said first shaft is arranged through a first end of said cylinder head and said actuator is arranged in a bore formed in a second end of said cylinder head opposite to said first end of said cylinder head as viewed in said extending direction of said crankshaft.

* * * * *